US009029304B2

(12) United States Patent
Walker

(10) Patent No.: US 9,029,304 B2
(45) Date of Patent: May 12, 2015

(54) LUBRICATING OIL ADDITIVE COMPOSITION AND METHOD OF MAKING THE SAME

(75) Inventor: Deane S. Walker, Concord, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 317 days.

(21) Appl. No.: 12/242,369

(22) Filed: Sep. 30, 2008

(65) Prior Publication Data

US 2010/0081594 A1 Apr. 1, 2010

(51) Int. Cl.
*C10M 141/08* (2006.01)
*C10M 159/24* (2006.01)

(52) U.S. Cl.
CPC ..... *C10M 141/08* (2013.01); *C10M 159/24* (2013.01); *C10M 2203/1025* (2013.01); *C10M 2207/022* (2013.01); *C10M 2207/126* (2013.01); *C10M 2207/281* (2013.01); *C10M 2215/08* (2013.01); *C10M 2215/28* (2013.01); *C10M 2217/043* (2013.01); *C10M 2219/044* (2013.01); *C10M 2219/046* (2013.01); *C10N 2220/021* (2013.01); *C10N 2220/023* (2013.01); *C10N 2230/52* (2013.01); *C10N 2230/70* (2013.01); *C10N 2240/08* (2013.01)

(58) Field of Classification Search
USPC ..... 508/551, 287, 391, 556, 291
See application file for complete search history.

(56) References Cited

U.S. PATENT DOCUMENTS

| | | | | | |
|---|---|---|---|---|---|
| 2,992,708 | A | | 7/1961 | Lyon | |
| 3,018,291 | A | | 1/1962 | Anderson et al. | |
| 3,024,237 | A | | 3/1962 | Drummond et al. | |
| 3,100,673 | A | | 8/1963 | Ulmer et al. | |
| 3,172,892 | A | | 3/1965 | LeSuer et al. | |
| 3,219,666 | A | | 11/1965 | Norman et al. | |
| 3,272,746 | A | | 9/1966 | LeSuer et al. | |
| 3,933,659 | A | * | 1/1976 | Lyle et al. | 508/294 |
| 4,062,785 | A | | 12/1977 | Nibert | |
| 4,293,431 | A | * | 10/1981 | Demoures et al. | 508/392 |
| 5,021,176 | A | | 6/1991 | Bullen et al. | |
| 5,137,980 | A | * | 8/1992 | DeGonia et al. | 525/327.6 |
| 5,282,991 | A | | 2/1994 | Malcolm et al. | |
| 5,286,394 | A | | 2/1994 | Moore | |
| 5,558,802 | A | | 9/1996 | Dowling | |
| 5,565,528 | A | * | 10/1996 | Harrison et al. | 525/327.6 |
| 6,051,536 | A | | 4/2000 | Igarashi | |
| 6,337,309 | B1 | | 1/2002 | Watts et al. | |
| 6,428,916 | B1 | | 8/2002 | Grasso et al. | |
| 6,759,375 | B2 | | 7/2004 | Curtis et al. | |
| 6,803,350 | B2 | | 10/2004 | Lantuejoul et al. | |
| 6,867,171 | B2 | | 3/2005 | Harrison et al. | |
| 2002/0055440 | A1 | | 5/2002 | Balasubramaniam | |
| 2004/0209787 | A1 | * | 10/2004 | Aoyagi et al. | 508/390 |
| 2005/0202981 | A1 | * | 9/2005 | Eveland et al. | 508/295 |
| 2008/0015125 | A1 | | 1/2008 | Devlin et al. | |
| 2008/0119377 | A1 | | 5/2008 | Devlin et al. | |
| 2008/0176777 | A1 | | 7/2008 | Milner et al. | |
| 2008/0187875 | A1 | | 8/2008 | Goto et al. | |

FOREIGN PATENT DOCUMENTS

| | | | |
|---|---|---|---|
| CA | 2131098 | | 7/1999 |
| CA | 2443902 | | 5/2011 |
| CN | 1126810 | C | 3/2000 |
| CN | 1556846 | A | 12/2004 |
| EP | 0 120 665 | | 3/1984 |
| EP | 1174489 | A1 | 1/2002 |
| EP | 1686167 | A1 | 8/2006 |
| GB | 1400261 | A | 6/1976 |
| JP | 02175794 | A | 7/1990 |
| JP | 0978079 | A | 3/1997 |
| JP | 09316476 | A | 12/1997 |
| JP | 2000087061 | A | 3/2000 |
| JP | 2000336386 | A | 12/2000 |
| JP | 2004273723 | A | 9/2004 |
| JP | 2005082709 | A | 3/2005 |
| JP | 2005120238 | A | 5/2005 |
| WO | WO 2007005423 | A2 * | 1/2007 |

OTHER PUBLICATIONS

International Search Report issued in counterpart European Patent Application No. 09818199.3.
A Japanese Office Action issued in counterpart Japanese Application No. 2011-529076 dated Oct. 29, 2013.
A Communication issued in counterpart European Patent Application No. 09 818 199.3-1352 dated Sep. 1, 2014.

* cited by examiner

*Primary Examiner* — James Goloboy

(57) ABSTRACT

An oil-soluble lubricating oil additive composition comprising (a) at least 3.5 wt-% of at least one friction modifier selected from the group consisting of fatty acids, fatty acid amides, fatty acid esters, and alkane diols which have a melting point of greater than 30° C.; (b) at least 10 wt-% actives dispersant; and (c) a sufficient amount of surfactant to make said additive composition haze-, sediment-, and skin-free, provided that said additive composition contains at least 150 mm surfactant per kg of said lubricating oil additive composition.

6 Claims, No Drawings

LUBRICATING OIL ADDITIVE COMPOSITION AND METHOD OF MAKING THE SAME

FIELD OF THE INVENTION

The present invention is directed to an improved lubricating oil additive composition and composition that may be used in a tractor hydraulic fluid.

BACKGROUND OF THE INVENTION

Organic friction modifiers have been used in lubricating oil applications for many years. Friction modifiers allow lubricants to achieve friction characteristics necessary for smooth operation of e.g. transmission fluids, tractor fluids, brake fluids, and hydraulic fluids, and also improve fuel economy in engine oils.

The most cost-effective friction modifiers are often C10-C30 organic compounds with a linear or nearly linear non-polar group at one end, and a polar functionality such as a carboxylic acid, a carboxylic acid derivative such as an ester, amide, or salt, an amine, or an alcohol or diol, at the other end. Such friction modifiers function through by forming adsorbed layers on a metal surface, with the polar end attaching to the metal, and the non-polar end sticking out into the lubricant.

In order to be adsorbed from the lubricant onto the metal, friction modifiers must be only marginally soluble in a lubricant. This can cause problems with solubility of the friction modifier in the finished lubricant. In addition, since additive suppliers generally furnish additives to lubricant manufacturers in the form of a mixture of additives, or additive composition, solubility of the friction modifier in the additive composition is also a concern. These problems are exacerbated when the friction modifier is used at high concentrations, or when the friction modifier is a solid at ambient temperatures.

In addition, we have discovered that the presence of co-additives such as high molecular weight dispersants can also decrease the solubility of friction modifiers in lubricating oils and lubricant additive compositions.

DESCRIPTION OF THE RELATED ART

Nibert, U.S. Pat. No. 4,062,785 discloses a non-aqueous lubricant that comprises white mineral oil and a minor proportion of a fatty amide.

Richards et al., U.S. Pat. No. 4,280,916 discloses motor oil compositions formulated for use as crankcase lubricants in internal combustion engines that are improved by including in said motor oil a small amount of at least one $C_8$-$C_{24}$ aliphatic monocarboxylic acid amide.

Moore, U.S. Pat. No. 5,286,394 discloses a lubricating oil composition that comprises (a) a major amount of an oil having lubrication viscosity; (b) a minor amount of a friction modifying, polar and surface-active compound; (c) a minor amount of a Group IA alkali metal containing compound and (d) a minor amount of a transition element metal in a hydrocarbon-soluble or dispersible compound.

Davis et al., Published International Patent Application No., WO 92/18588 discloses a lubricating oil composition comprising a major amount of an oil of lubricating viscosity; and (a) an amount of at least one alkali metal overbased salt of an acidic organic compound to provide at least about 0.0019 equivalents of alkali metal per 100 grams of the lubricating composition; (b) at least 1.60 by weight of at least one dispersant; (c) at least one metal dihydrocarbyl dithiophosphate; (d) at least one antioxidant; and (e) at least one magnesium overbased metal salt of an acidic organic compound provided that the lubricating oil composition is free of calcium overbased sulfonate and calcium overbased phenate; provided that the composition contains less than about 0.08% by weight calcium; and provided that (c) and (d) are not the same.

Igarashi et al., U.S. Pat. No. 6,051,536 discloses an oil composition for continuously variable transmissions comprising base oil, (a) a sulfonate, (b) an ashless dispersant, (c) an acid amide, (d) an organo-molybdenum compound, and (e) an amine antioxidant.

European Published Patent Application No. 0120665 discloses a soluble-oil, suitable when diluted with water, for use as a cutting fluid comprising (i) an alkali or alkaline earth metal alkyl benzene sulphonate; (ii) a fatty acid diethanolamide; (iii) a mixed alkanolamine borate; (iv) a polyisobutenesuccinimide; and a major proportion of mineral oil.

Curtis, U.S. Pat. No. 6,759,375 discloses a sump-lubricated internal combustion engine equipped with exhaust gas recycle, lubricated with (a) an oil of lubricating viscosity; (b) 0.05 to 1 percent by weight of an amide of an aliphatic carboxylic acid; and (c) at least one additional dispersant, detergent, or anti-wear agent.

SUMMARY OF THE INVENTION

It has now been discovered that the inclusion of sufficient quantities of surfactant, such as are found in lubricating oil detergents, solves the problem of the low solubility of high melting point friction modifiers when used in combination with lubricating oil dispersants in both lubricating oils and lubricating oil additive compositions.

In its broadest embodiment, the present invention is directed to lubricating oil additive composition comprising (a) at least 3.5 wt-% of at least one friction modifier selected from the group consisting of fatty acids, fatty acid amides, fatty acid esters, and alkane diols which have a melting point of greater than 30 degrees Celsius;
(b) at least 10 wt-% of at least one dispersant; and
(c) a sufficient amount of at least one surfactant to make said additive composition haze-, sediment-, and skin-free, provided that said additive composition contains at least 150 mm surfactant per kg of said lubricating oil additive composition.

The present invention is also directed to a lubricating oil composition comprising (a) a major amount of base oil of lubricating viscosity;
(b) at least 0.35 wt-% of at least one friction modifier selected from the group consisting of fatty acids, fatty acid amides, fatty acid esters, and alkane diols which have a melting point of greater than 30° C.;
(c) at least 1 wt-% dispersant; and
(d) a sufficient amount of surfactant to make said lubricating oil composition haze-, sediment-, and skin-free, provided that said lubricating oil composition contains at least 15 mm of total surfactant per kg of said lubricating oil composition.

DETAILED DESCRIPTION OF THE INVENTION

While the invention is susceptible to various modifications and alternative forms, specific embodiments thereof are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DEFINITIONS

The following terms used with the description are defined as such:

"A major amount" of a base oil refers to a concentration of the base oil within the lubricating oil composition of at least about 40 wt. %. In some embodiments, "a major amount" of a base oil refers to a concentration of the base oil within the lubricating oil composition of at least about 50 wt. %, at least about 60 wt. %, at least about 70 wt. %, at least about 80 wt. %, or at least about 90 wt. %.

"On an actives basis" indicates that only the active component(s) of a particular additive are considered when determining the concentration or amount of that particular additive within the overall lubricating oil composition or the lubricating oil additive composition. Diluents and any other inactive components of the additive, such as diluent oil or unreacted starting material, are excluded. Unless otherwise indicated, in describing the lubricating oil composition or the lubricating oil additive composition, concentrations provided herein for all additives are indicative of the concentration of the additive, and not of any inactive components within the additive, within the lubricating oil composition or the lubricating oil additive composition.

"Molecular weight" refers to the number average molecular weight of a compound, and is expressed as Daltons.

A "hydraulic fluid" is a fluid used to transfer power through a hydraulic system.

A "tractor hydraulic fluid" is a multipurpose non-aqueous lubricant used to lubricate tractor hydraulics. It must be able to serve as a lubricant not only for hydraulic systems, but must also serve as a transmission lubricant, wet brake and wet clutch lubricant, and a final drive lubricant. In general a tractor hydraulic fluid contains higher concentrations of lubricant additives than does a simple hydraulic fluid. It generally will meet a specification defined by an OEM such as John Deere or Massey-Ferguson.

The term "PIB" is an abbreviation for polyisobutene.

The term "PIBSA" is an abbreviation for polyisobutenyl succinic anhydride.

The term "succinic group" refers to a group having the formula:

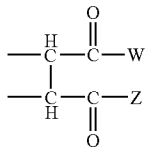

wherein W and Z are independently selected from the group consisting of —OH, —Cl, —O— lower alkyl or taken together are —O— to form a succinic anhydride group. The term "—O-lower alkyl" is meant to include alkoxy of 1 to 6 carbon atoms.

The term "succinimide" is understood in the art to include many of the amide, imide, etc. species which are also formed by the reaction of a succinic anhydride with an amine. The predominant product, however, is succinimide and this term has been generally accepted as meaning the product of a reaction of an alkenyl- or alkyl-substituted succinic acid or anhydride with an amine. Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,291; 3,024,237; 3,100,673; 3,219,666; 3,172,892; and 3,272,746, the disclosures of which are hereby incorporated by reference.

The term "alkenyl or alkylsuccinic acid derivative" refers to a structure having the formula:

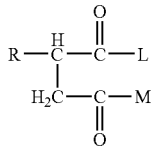

wherein L and M are independently selected from the group consisting of —OH, —Cl, —O—, lower alkyl or taken together are —O— to form an alkenyl or alkylsuccinic anhydride group.

The term "alkylvinylidene" or "alkylvinylidene isomer" refers to high molecular weight olefins and polyalkylene components having the following vinylidene structure:

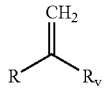

wherein R is alkyl or substituted alkyl of sufficient chain length to give the resulting molecule solubility in lubricating oils and fuels, thus R generally has at least about 30 carbon atoms, preferably at least about 50 carbon atoms and $R_v$ is lower alkyl of about 1 to about 6 carbon atoms. When $R_v$ is methyl, the alkylvinylidene isomer is methylvinylidene.

The term "soluble in lubricating oil" refers to the ability of a material to dissolve in aliphatic and aromatic hydrocarbons such as lubricating oils or fuels in essentially all proportions.

The term "high molecular weight olefins" refers to olefins (including polymerized olefins having a residual unsaturation) of sufficient molecular weight and chain length to lend solubility in lubricating oil to their reaction products. Typically olefins having about 30 carbons or more suffice.

The term "high molecular weight polyalkyl" refers to polyalkyl groups of sufficient molecular weight such that the products prepared having such sufficient molecular weights are soluble in lubricating oil. Typically these high molecular weight polyalkyl groups have at least about 30 carbon atoms, preferably at least about 50 carbon atoms. These high molecular weight polyalkyl groups may be derived from high molecular weight polyolefins.

The term "amino" refers to —NR1R2 wherein R1 and R2 are independently hydrogen or a hydrocarbyl group.

The term "alkyl" refers to both straight- and branched-chain alkyl groups.

The term "lower alkyl" refers to alkyl groups having 1 to about 6 carbon atoms and includes primary, secondary and tertiary alkyl groups. Typical lower alkyl groups include, for example, methyl, ethyl, n-propyl, isopropyl, n-butyl, sec-butyl, t-butyl, n-pentyl, n-hexyl and the like.

The term "polyalkyl" refers to an alkyl group that is generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms.

More preferred mono-olefins include propylene, butylene, particularly isobutylene, 1-octene and 1-decene. Preferred, polyolefins prepared from such mono-olefins include polypropylene, polybutene, especially polyisobutene.

Lubricating Oil Additive Composition

One embodiment of the present invention is directed to a lubricating oil additive composition. This composition comprises a friction modifier, a dispersant and a surfactant. In one embodiment, the additive composition may be employed in a tractor hydraulic fluid.

In one embodiment of the invention, the additive composition comprises (a) at least 3.5 wt % of at least one friction modifier selected from the group consisting of fatty acids, fatty acid amides, fatty acid esters, and alkane diols, which have a melting point of greater than 30 degrees Celsius; (b) at least 10 wt % dispersant; and (c) a sufficient amount of surfactant to make said lubricating oil composition haze-, sediment- and skin-free, provided that said additive composition contains at least 150 mm surfactant per kg of the additive composition.

Preferably, when the additive composition is employed in a tractor hydraulic fluid, the tractor hydraulic fluid contains an oleamide type friction modifier; from about 1 wt % to about 3.75 wt % of an alkenyl succinic anhydride based dispersant; and an amount of a low overbased detergent.

The additive composition, for reasons of handling, is commonly supplied as a concentrate containing from about 20 wt % to about 80 wt % of an organic diluent, more preferably 20 wt % to 70 wt %, even more preferably 20 to 60 wt %. The diluent should provide the composition with the necessary handling characteristics, e.g. appropriate viscosity and low temperature properties; help to solubilize additives in the composition, and be compatible with the end use of the additive composition. As will be described, the addition of a surfactant may allow the use of less diluent in the additive composition than would otherwise be necessary. The diluent is preferably a base oil as described hereinafter.

Friction Modifier

Friction modifiers act to either increase or decrease friction at the boundary between surfaces that are moving relative to one another. Organic friction modifiers do not contain metals, such as are found in metallo-organic compounds such as molybdenum dithiocarbamates.

In one embodiment of the invention, at least one friction modifier is employed in the lubricating oil additive composition. Preferably, the friction modifier is a high melting point organic friction modifier. High melting point organic friction modifiers are relatively linear organic molecules. The at least one friction modifier employed in the present invention is selected from the group consisting of fatty acids, fatty acid amides, fatty acid esters, and alkane diols which have a melting point of greater than 30° C. Preferably, the friction modifier(s) employed in the present invention has a melting point of at least 40° C.; more preferred, the friction modifier has a melting point of at least 45° C.; even more preferred, the friction modifier has a melting point of at least 50° C.; most preferred, the friction modifier has a melting point of at least 55° C.; and even most preferred, the friction modifier has a melting point of at least 60° C.

In one embodiment of the present invention, the high melting point organic friction modifier is selected from the group consisting of fatty acid amides and alkane diols. In one preferred embodiment, the high melting point organic friction modifier is an alkane diol. More preferred, the alkane diol is a vicinal alkane diol, i.e. 1,2-hydroxyalkane. A particularly preferred alkane diol is Adeka FMG-168, which is believed to be a mixture of $C_{16}$ and $C_{18}$ 1,2-hydroxyalkanes. In another preferred embodiment, the high melting point organic friction modifier is a fatty acid amide. Preferably, the fatty acid amide is oleyl amide. In another embodiment, mixtures of high melting point friction modifiers, such as mixtures of high melting point fatty acid amides and alkane diols, may be used.

The concentration of the one or more high melting point organic friction modifiers within the lubricating oil composition on an actives basis is at least about 0.35 wt. %, more preferably at least 0.40 wt. %, at least 0.45 wt. %, at least 0.5 wt. %, at least 0.6 wt. %, or even at least 0.7 wt. %. The concentration of the one or more high melting point organic friction modifiers within the lubricating oil additive composition on an actives basis is at least about 3.5 wt. %, more preferably at least 4.0 wt. %, at least 4.5 wt. %, at least 5.0 wt. %, at least 6.0 wt. %, or even at least 7.0 wt. %.

Dispersant

Typically, a dispersant functions to suspend insoluble contaminants in a lubricating oil, thereby keeping surfaces contacting the lubricating oil clean. Dispersants may also function to reduce changes in lubricating oil viscosity by preventing the growth of large contaminant particles in a lubricating oil.

Dispersants contain at least one high number-average molecular weight hydrocarbon group; at least one polar group; and at least one linking group to connect the polar and nonpolar groups. Dispersants are typically metal-free, generally containing only carbon, hydrogen, nitrogen and oxygen, sometimes containing boron.

The high number-average molecular weight hydrocarbon group in the dispersant is generally a polyolefin, such as a polyethylene group, an olefin copolymer such as an ethylene-propylene copolymer, a polybutene polymer, or a polyisobutene polymer. A preferred hydrocarbon group is a polyisobutene polymer, especially a polyisobutene polymer containing a high proportion of methylvinylidene olefin groups, such as at least 70 mole % methylvinylidene polyisobutene, or at least at least 80 mole % methylvinylidene. Such materials are commercially available from e.g. BASF as Glissopal® polyisobutene.

The number average molecular weight of the hydrocarbon group is at least 500, preferably at least 700 Daltons. The number average molecular weight for a hydrocarbon group is less than about 5000 Daltons, preferably less than 3000. Ranges for the molecular weight can be between 500 and 5000, such as about 600-2800, about 700-2700, about 800-2600, about 900-2500, about 1000-2400, about 1100-2300, about 1200-2200, about 1300-2100, or even about 1400-2000. A particularly preferred embodiment of the hydrocarbon group is a high methylvinylidene polyisobutene with a molecular weight of between 1000 and 2500.

The polar group is generally a polar low molecular weight compound that is attracted to the surface of a contaminant particle. Common polar groups are amines and alcohols, especially polyamines and polyalcohols. Especially preferred polyamines are the polyalkylene polyamines, especially polyethylene polyamines such as diethylene triamine, triethylene polyamine, and the like. Especially preferred polyalkylene polyamines are triethylene tetramine, tetraethylene pentamine, and the so-called "heavy polyamines", which are bottoms products of distillation of lighter polyalkylene polyamines. Mixtures of polyamines may also be used.

The linking group may be any suitable linking group that connects polar compound(s) to hydrocarbon groups. Common linking groups are the succinimide, succinate ester, and phenolic groups. Commonly the linking group is first attached to the hydrocarbon group The dispersant employed in the present invention may be any suitable dispersant or mixture of multiple dispersants for use in a lubricating oil. In one embodiment of the present invention, the dispersant is an ashless dispersant, such as an ashless dispersant that comprises an alkenyl- or alkyl-succinimide or a derivative thereof, such as a polyalkylene succinimide (preferably, polyisobutene succinimide).

In another embodiment of the present invention, the dispersant is an alkali metal or mixed alkali metal, alkaline earth metal borate, dispersion of hydrated alkali metal borate, dispersion of alkaline-earth metal borate, polyamide ashless dispersant, benzylamine, Mannich type dispersant, phosphorus-containing dispersant, or combination or mixture thereof. These and other suitable dispersants have been described in Morier et al., "Chemistry and Technology of Lubricants," 2nd Edition, London, Springer, Chapter 3, pages 86-90 (1996); and Leslie R. Rudnick, "Lubricant Additives: Chemistry and Applications," New York, Marcel Dekker, Chapter 5, pages 137-170 (2003), both of which are incorporated herein by reference in their entirety.

In one embodiment of the present invention, the dispersant is a succinimide or a derivative thereof. In another embodiment, the dispersant is a succinimide or derivative thereof which is obtained by reaction of a polybutenylsuccinic anhydride and a polyamine. In yet another embodiment, the dispersant is a succinimide or derivative thereof which is obtained by reaction of a polybutenylsuccinic anhydride and a polyamine, wherein the polybutenylsuccinic anhydride is produced from polybutene and maleic anhydride (such as by a thermal reaction method using neither chlorine nor a chlorine atom-containing compound).

In another embodiment of the present invention, the dispersant is a succinimide reaction product of the condensation reaction between polyisobutenyl succinic anhydride (PIBSA) and one or more alkylene polyamines. The PIBSA, in this embodiment, can be the thermal reaction product of high methylvinylidene polyisobutene (PIB) and maleic anhydride.

In another preferred embodiment, the dispersant is a primarily bis-succinimide reaction product derived from PIB having a number average molecular weight (Mn) of about 500-3000, such as about 600-2800, about 700-2700, about 800-2600, about 900-2500, about 1000-2400, about 1100-2300, about 1200-2200, about 1300-2100, or even about 1400-2000.

In another embodiment, the dispersant is a primarily bis-succinimide reaction product derived from PIB having a Mn of at least about 600, at least about 800, at least about 1000, at least about 1100, at least about 1200, at least about 1300, at least about 1400, at least about 1500, at least about 1600, at least about 1700, at least about 1800, at least about 1900, at least about 2000, at least about 2100, at least about 2200, at least about 2300, at least about 2400, at least about 2500, at least about 2600, at least about 2700, at least about 2800, at least about 2900, at least about 3000.

In one embodiment, for example, the dispersant is a primarily bis-succinimide reaction product derived from 1000 Mn PIB, which succinimide in another preferred embodiment is subsequently borated to achieve a boron concentration of about 0.1-3 wt. % (such as about 1-2 wt. %, such as 1.2 wt. %) in the succinimide.

In another embodiment, the dispersant is a primarily bis-succinimide reaction product derived from 1300 Mn PIB, which succinimide in another preferred embodiment is subsequently borated to achieve a boron concentration of about 0.1-3 wt. % (such as about 1-2 wt. %, such as 1.2 wt. %) in the succinimide. In another embodiment, the dispersant is a primarily bis-succinimide reaction product derived from 2300 Mn PIB, which succinimide in another preferred embodiment is subsequently reacted with ethylene carbonate.

In another preferred embodiment, the dispersant is a succinimide prepared by the reaction of a high molecular weight alkenyl- or alkyl-substituted succinic anhydride and a polyalkylene polyamine having 4 to 10 nitrogen atoms (average value), preferably 5 to 7 nitrogen atoms (average value) per mole. The alkenyl or alkyl group of the alkenyl or alkyl succinimide compound, in this regard, can be derived from a polybutene having a number average molecular weight of about 900-3000, such as about 1000-2500, about 1200-2300, or even about 1400-2100. In some embodiments, the reaction between polybutene and maleic anhydride for the preparation of polybutenyl succinic anhydride can be performed by a chlorination process using chlorine. Accordingly, in some embodiments, the resulting polybutenyl succinic anhydride as well as a polybutenyl succinimide produced from the polybutenyl succinic anhydride has a chlorine content in the range of approximately 2,000 to 3,000 ppm (wt). In contrast, a thermal process using no chlorine gives a polybutenyl succinic anhydride and a polybutenyl succinimide having a chlorine content in a range of such as less than 30 ppm (wt). Therefore, a succinimide derived from a succinic anhydride produced by the thermal process is preferred, in some embodiments, due to the smaller chlorine content in the lubricating oil composition.

In another embodiment, the dispersant comprises a modified alkenyl- or alkyl-succinimide which is after-treated with a compound selected from a boric acid, an alcohol, an aldehyde, a ketone, an alkylphenol, a cyclic carbonate (e.g., ethylene carbonate), an organic acid, a succinamide, a succinate ester, a succinate ester-amide, pentaerythritol, phenate-salicylate and their post-treated analogs or the like, or combinations or mixtures thereof. Preferable modified succinimides are borated alkenyl- or alkyl-succinimides, such as alkenyl- or alkyl-succinimides which are after-treated with boric acid or a boron-containing compound. In another embodiment, the dispersant comprises alkenyl- or alkyl-succinimide that has not been after- or post-treated.

Other dispersants which may be employed in the presently claimed invention, include but are not limited to, esters of polyalcohols and polyisobutenyl succinic anhydride, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

The dispersant additive ("dispersant") can be in any suitable form. In one embodiment, the dispersant is mixed or blended in the lubricating oil composition in the form of a concentrate comprising any suitable process or diluent oil (such as any Group I oil, Group II oil, or combination or mixture thereof) and the dispersant. In one embodiment, the process or diluent oil is an oil that is different from the base oil (e.g., Group I base oil) of the lubricating oil composition, such as a different Group I base oil, a Group II base oil, or a mixture or combination thereof. In another embodiment, the process or diluent oil is an oil that is the same as the base oil (e.g., Group I base oil) of the lubricating oil composition.

The concentration of the one or more dispersants within the lubricating oil composition on an actives basis is at least about 1.0 wt. %, more preferably at least 1.25 wt. %, at least 1.5 wt. %, at least 1.75 wt. %, at least 2.0 wt. %, or even at least 2.5 wt. %. The concentration of the one or more dispersants within the lubricating oil additive composition on an actives basis is at least about 10 wt. %, more preferably at least 12.5 wt. %, at least 15 wt. %, at least 17.5 wt. %, at least 20 wt. %, or even at least 25 wt. %.

Surfactant

A surfactant is an organic acid that can used to make a lubricating oil detergent. The surfactant includes at least one relatively low molecular weight non-polar tail (relative compared to dispersants) and a polar head. The molecular weight of the non-polar tail must be large enough to make the surfactant or resulting detergent oil-soluble and compatible with other additives. Typically the molecular weight of the non-polar tail will be at least 120 Daltons (i.e. about $C_9$); more preferably at least about 150 Daltons (i.e. about $C_{12}$); more preferably at least about 220 Daltons (i.e. about $C_{16}$). The molecular weight of the tail is typically less than about 560 Daltons ($C_{40}$), more preferably less than about 420 Daltons ($C_{30}$). The tail is generally a hydrocarbon, and can be linear or branched or a mixture of linear and branched. The tail is often derived from an olefinic compound such as an oligomer of ethylene, propylene or butylene or a mixture of olefinic monomers, or can be derived from another source such as olefins derived from the thermal cracking of wax. Alternatively, the non-polar portion may be derived from an aromatic lubricating oil basestock.

The polar head of the surfactant may be any polar moiety which forms a salt with a metal. Particularly preferred polar moieties are sulfonic acid groups, especially aryl sulfonic acid groups; hydroxyaromatic groups, especially phenolic groups; hydroxyaromatic aromatic carboxylic acid groups, such as a hydroxyaromatic benzoic acid group, commonly referred to as a "salicylic acid" group; and carboxylic acid groups, which can be supplied from for example a fatty acid, a naphthenic acid, or a petroleum oxidate. Most especially preferred are surfactants containing a sulfonic acid group, especially an aryl sulfonic acid group. Most preferred surfactants are alkylated aromatic sulfonic acids, especially alkylated benzene sulfonic acids or alkylated toluene sulfonic acids.

In one embodiment, other surfactants may also be employed. These surfactants include, but are not limited to, sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

The surfactant may be supplied to the lubricating oil composition as a component of a detergent. A detergent is a metal salt of a surfactant. The functions of detergents can include neutralization of acidic combustion gases; cleaning and keeping clean engine surfaces, especially surfaces that are at high temperature; oxidation and corrosion inhibition. Metals used to make the metal salt of a surfactant include alkaline earth metals; alkali metals; and certain transition metals, such as zinc. Particularly preferred metals for detergents are the alkaline earth metals, especially calcium and magnesium, most especially calcium.

The detergent may be underbased, containing a less than stoichiometric amount of metal relative to the surfactant; neutral, containing an amount of metal approximately equal to that of the surfactant; or overbased, containing a greater than stoichiometric amount of metal relative to the surfactant. At least a portion of the metal in an overbased detergent is present in the form of a dispersed colloid, generally as the metal hydroxide, or as the salt of the metal and an overbasing acid, typically the metal carbonate, or as a mixture of hydroxide and salt of overbasing acid. Detergents are commonly provided commercially as a concentrate containing a significant amount of lubricating oil, typically between 20 and 60 wt-% lubricating oil. Particularly preferred detergents for this invention are the alkaline earth metal salts of alkylated aromatic sulfonic acids, especially alkylated benzene sulfonic acids or alkylated toluene sulfonic acids, especially calcium and magnesium salts, most especially calcium salts. For reasons of cost and convenience, an especially preferred detergent is a neutral or slightly overbased calcium salt of an alkylated aromatic sulfonic acid, especially a salt that does not contain a significant amount of the salt of an overbasing gas.

The lubricating oil may comprise one or more of the above-described surfactants.

The amount of surfactant that must be added to the lubricating oil composition and additive composition depends upon the amount and nature of the dispersant and the high melting point friction modifier that are also contained in the lubricating oil composition and additive composition. One aspect of the invention is that the lubricating oil composition must contain at least about 15 millimoles of surfactant per kg of lubricating oil composition (abbreviated heretofore as mm/kg). Another aspect of the present invention is that the lubricating oil additive composition must contain at least about 150 millimoles of surfactant per kg of lubricating oil additive composition.

The concentration of surfactant may be measured by any convenient method, or determined from knowledge of the manufacturing of detergent added to the lubricating oil composition or additive composition.

One method of measuring the surfactant concentration of a detergent is disclosed in U.S. Pat. No. 5,558,802. According to this patent, the moles of calcium salt of an organic acid present can be determined directly in some cases and in others must be derived. When the salt is a calcium sulfonate, direct analysis is possible using the liquid chromatography method described in ASTM 3712. For other organic acids, the moles of salt must be derived. When this is required titrimetry including two phase titrimetric methods, total acid number (TAN) as determined using ASTM D664, dialysis and other well known analytical techniques allow determination of the organic salt content. Thus for phenates and carboxylates (including salicylates) the total amount of metal must be determined and allocated between organic and inorganic acids using a metal ratio. The total amount of calcium present is conveniently determined by inductively coupled plasma atomic emission spectrometry—ASTM D4951. Metal ratio is defined as the total amount of metal present divided by the amount of metal in excess of that required to neutralize any organic acid present, i.e., the amount of metal neutralizing inorganic acids. Metal ratios are quoted by manufacturers of commercial detergents and can be determined by a manufacturer having knowledge of the total amount of salts present and the average molecular weight of the organic acid. The amount of metal salt present in a detergent may be determined by dialyzing the detergent and quantifying the amount of the residue. If the average molecular weight of the organic salts is not known, the residue from the dialyzed detergent can be treated with strong acid to convert the salt to its acid form, analyzed by chromatographic methods, proton NMR, and mass spectroscopy and correlated to acids of known properties. More particularly, the detergent is dialysed and then residue is treated with strong acid to convert any salts to their respective acid form. The hydroxide number of the mixture can then be measured by the method described in ASTM D1957. If the detergent contains non-phenolic hydroxyl groups on the phenolic compound (e.g., alcoholic derivatives of ethylene glycol used in manufacture of commercial phenates or carboxylic acid groups on salicylic acid), separate analyses must be conducted to quantify the amounts of those hydroxyl groups so that the hydroxide number determined by ASTM D1957 can be corrected. Suitable techniques to determine the quantity of non-phenolic hydroxyl groups include analyses by mass spectroscopy, liquid chromatography, and proton NMR and correlation to compounds having known properties.

A second method for deriving the number of moles of calcium salt of an organic acid present assumes that all of the organic acid charged to make the component is in fact converted to the salt. When the lubricant contains more than one calcium salt of amounts of individual salts are added together to reach a total amount of calcium salt. In practice the two methods can give slightly different results, but both are believed to be sufficiently precise to allow determination of the amount of salt present to the precision required to practice the present invention.

Lubricating Oil Composition

The lubricating oil additive composition described above is generally added to a base oil that is sufficient to lubricate moving parts, for example internal combustion engines, gears, and transmissions. Typically, the lubricating oil composition of the present invention comprises a major amount of oil of lubricating viscosity and a minor amount of the lubricating oil additive composition.

The base oil employed may be any of a wide variety of oils of lubricating viscosity. The base oil of lubricating viscosity used in such compositions may be mineral oils or synthetic oils. A base oil having a viscosity of at least 4 cSt at 100° C. and a pour point below 20° C., preferably at or below 0° C., is desirable. The base oils may be derived from synthetic or natural sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene, polyalphaolefin or PAO oils, or oils prepared from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Thus, the base oil can be a refined paraffin type base oil, a refined naphthenic base oil, or a synthetic hydrocarbon or non-hydrocarbon oil of lubricating viscosity. The base oil can also be a mixture of mineral and synthetic oils.

In one embodiment, the base oil is a Group I base oil, or a blend of two or more different Group I base oils. The Group I base oils can be any petroleum derived base oil of lubricating viscosity as defined by the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference in its entirety. The API guideline defines a base stock as a lubricant component that may be manufactured using a variety of different processes. In this regard, a Group I base oil is an oil having (a) a total sulfur content greater than or equal to about 0.03 wt. % (as determined by ASTM D 2270), or a saturates content less than 90 wt. % (as determined by ASTM D 2007), and (b) a viscosity index (VI) of 80-120 (as determined by ASTM D 4294, ASTM D 4297 or ASTM D 3120).

Group I base oils can comprise light overhead cuts and heavier side cuts from a vacuum distillation column and can also include, for example, Light Neutral, Medium Neutral, and Heavy Neutral base stocks. The petroleum derived base oil also may include residual stocks or bottoms fractions, such as, for example, bright stock. Suitable Group I base stocks are ExxonMobil CORE® 100, ExxonMobil CORE® 150, ExxonMobil CORE® 600, and ExxonMobil CORE® 2500, base stocks.

In one embodiment, the base oil is a Group II base oil. Group II base oils are primarily paraffinic and have less than 0.03% sulfur by weight, at least 90% saturates by weight, and a viscosity index ranging from 80 to 120. Suitable Group II base stocks are Chevron 100R, 220R, 600R and 5R Group II base stocks, available from Chevron Products Co. (San Ramon, Calif.).

In one embodiment, the base oil can be a blend or mixture of two or more, three or more, or even four or more base stocks having different molecular weights and viscosities, wherein the blend is processed in any suitable manner to create a base oil having suitable properties.

Other Additives

In one embodiment of the present invention, the following additive components are examples of some of the components that may be favorably employed in the lubricating oil composition.

These examples of additives are provided to illustrate the present invention, but they are not intended to limit it:

1. Anti-Oxidants

Anti-oxidants reduce the tendency of oils to deteriorate upon exposure to oxygen and heat. This deterioration is evidenced by the formation of sludge and varnish-like deposits, an increase in viscosity of the oil, and by an increase in corrosion or wear. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-I-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl). Diphenylamine-type oxidation inhibitors include, but are not limited to, alkylated diphenylamine, phenyl-alpha-naphthylamine, and alkylated-alpha-naphthylamine. Sulfur-containing oxidation inhibitors include ashless sulfides and polysulfides, metal dithiocarbamate (e.g., zinc dithiocarbamate), and 15-methylenebis(dibutyldithiocarbamate). Phosphorus compounds especially the alkyl phosphites, sulfur-phosphorus compounds, and copper compounds may also be used as antioxidants.

2. Anti-Wear Agents

Anti-wear agents reduce wear of moving metallic parts in conditions of continuous and moderate loads. Examples of such agents include, but are not limited to, phosphates and thiophosphates and salts thereof, carbamates, esters, and molybdenum complexes. Especially preferred anti-wear compounds are the amine phosphates.

3. Rust Inhibitors (Anti-Rust Agents)

Rust inhibitors correct against the corrosion of ferrous metals. These include (a) Nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol monooleate; and (b) miscellaneous other compounds such as stearic acid and other fatty acids, dicarboxylic acids, metal soaps, fatty acid amine salts, metal salts of heavy sulfonic acid, partial carboxylic acid ester of polyhydric alcohol, and phosphoric ester.

4. Demulsifiers

Demulsifiers promote the separation of oil from water which may come into contact with the oil through contamination. Demulsifiers include addition product of alkylphenol and ethylene oxide, polyoxyethylene alkyl ether, and polyoxyethylene sorbitan ester.

5. Extreme Pressure Agents (EP Agents)

Extreme pressure agents reduce wear of moving metallic parts in conditions of high loads. Examples of EP agents include sulfurized olefins, zinc dialky-1-dithiophosphate (primary alkyl, secondary alkyl, and aryl type), diphenyl sulfide, methyl trichlorostearate, chlorinated naphthalene, fluoroalkylpolysiloxane, lead naphthenate, neutralized or partially neutralized phosphates, dithiophosphates, and sulfur-free phosphates.

6. Low Melting Point Organic Friction Modifiers

Friction modifiers with melting points less than 30° C. may also be employed in this invention. These include certain fatty alcohols, fatty acids, fatty acid partial esters, fatty acid amides, alkylamines, alkyl amine alkoxylates, and borated versions of the preceding. Other friction modifiers include the metallorganic friction modifiers such as sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound. Copper-containing friction modifiers may also be used.

7. Multifunctional Additives

Some additives function to provide many functionalities simultaneously. In particular, the zinc aryl and alkyl dithiophosphates can simultaneously provide antiwear, extreme pressure, and oxidation inhibition. Especially preferred are the alkaryl, primary alkyl, and secondary alkyl zinc dithiophosphates. Primary alkyl zinc dithiophosphates are especially preferred.

8. Viscosity Index Improvers

Viscosity index improvers are used to increase the viscosity index of lubricating oils, thereby reducing the viscosity decrease of an oil with increasing temperature. Polymethacrylate polymers, ethylene-propylene copolymers, styrene-isoprene copolymers, hydrated styrene-isoprene copolymers, and polyisobutylene are all used as viscosity index improvers. Particularly preferred viscosity index improvers are the polymethacrylate polymers. Nitrogen- and oxygen-functionalized polymers, the so-called dispersant viscosity index improvers, may also be used.

9. Pour Point Depressants

Pour point depressants lower the temperature at which waxes precipitate out of lubricating oils, thus extending the temperature range in which the lubricating oil can operate before oil flow is impeded. Pour point depressants include polymethyl methacrylates, ester-olefin copolymers especially ethylene vinyl acetate copolymers, and others 10. Foam Inhibitors Foam inhibitors work to accelerate the release of gas entrained in a lubricant during operation. Common foam inhibitors include alkyl methacrylate polymers and dimethylsiloxane polymers.

11. Metal Deactivators

Metal deactivators hinder corrosion of metal surfaces, and chelate metal ions in solution in lubricating oils, thereby reducing oxidation caused by the catalytic effect of the metal ion. Common metal deactivators includes salicylidene propylenediamine, triazole derivatives, mercaptobenzothiazoles, thiadiazole derivatives, and mercaptobenzimidazoles.

The following examples are presented to illustrate specific embodiments of this invention and are not to be construed in any way as limiting the scope of the invention.

EXAMPLES

To illustrate the improved solubility characteristics of this invention, a number of additive compositions and lubricating oils containing differing amounts of friction modifier, high molecular weight dispersant, and detergent surfactant, were blended, and tested for compatibility.

Additive compositions were made by blending together appropriate amounts of the differing additive components at 150-160° F. The compositions were set aside to cool for a day, and then initial compatibility readings were taken. Portions of the compositions were then stored, and after several months final compatibility readings were taken. The scale for the additive composition compatibility readings was as follows:

0=Clear and bright, no skin on additive composition

1=Skin on additive composition

2=Very viscous additive composition

3=Additive composition forms gel

Finished oils were made by blending the appropriate additive composition and basestock at approximately 100° F. The finished oils were set aside to cool for a day, and then initial compatibility readings were taken. Portions of the oils were then stored, and after several months final compatibility readings were taken. The scale for the finished oil compatibility readings was as follows:

0=Clear and bright, no skin on finished oil

1=Skin on finished oil

2=Haze, floc, or deposit in finished oil

The additive compositions and lubricating oils of this invention are clear and bright (i.e. without noticeable haze or sediment) and skin-free for a time of at least two months, more preferably at least six months, after blending.

Effect of Detergent Surfactant Concentration on Finished Oil Compatibility

Finished tractor fluids were prepared to illustrate the effect of the detergent surfactant concentration on typical tractor fluids containing an oleyl amide friction modifier, which has a melting point of between 66° C. and 72° C.

Specifically, the finished tractor fluid comprised the following:

0.5 wt-% of oleyl amide;

1.91 wt-% as actives of an ethylene carbonate-treated bis-succinimide derived from 2300 MW polybutene succinic anhydride and heavy polyamine;

0.1 wt % of a 395 TBN oil concentrate of magnesium sulfonate;

The tractor hydraulic fluid also contained appropriate amounts of antiwear additives, corrosion inhibitors, friction modifiers not of the invention, and antioxidants.

Finished lubricants were made containing the above concentrations of additive and varying amounts of a 27 TBN oil concentrate of a Ca sulfonate (LOB Sulfonate) and a 320 TBN oil concentrate of a carbonated Ca sulfonate (HOB sulfonate) as shown in Table I, with the remainder of the hydraulic fluid being ConocoPhillips Pure Performance 110N base stock, to achieve the stated additive concentrations.

TABLE I

| Example | Wt-% LOB Sulfonate | Wt-% HOB Sulfonate | Total Detergent[1] Surfactant Concentration, mm surfactant/ Kg oil | Initial Appearance | Final Appearance |
|---|---|---|---|---|---|
| 1 | 0.00 | 1.26 | 7.1 | 2 | 2 |
| 2 | 0.00 | 1.57 | 8.7 | 2 | 2 |
| 3 | 0.31 | 1.26 | 10.0 | 2 | 2 |
| 4 | 0.00 | 1.89 | 10.3 | 2 | 2 |
| 5 | 0.31 | 1.57 | 11.6 | 2 | 2 |
| 6 | 0.00 | 2.20 | 11.9 | 1 | 2 |
| 7 | 0.62 | 1.26 | 12.9 | 2 | 0 |

TABLE I-continued

| Example | Wt-% LOB Sulfonate | Wt-% HOB Sulfonate | Total Detergent[1] Surfactant Concentration, mm surfactant/ Kg oil | Initial Appearance | Final Appearance |
|---|---|---|---|---|---|
| 8 | 0.31 | 1.89 | 13.2 | 1 | 2 |
| 9 | 0.00 | 2.51 | 13.5 | 1 | 2 |
| 10 | 0.77 | 1.26 | 14.3 | 0 | 2 |
| 11 | 0.62 | 1.57 | 14.5 | 1 | 0 |
| 12 | 0.92 | 1.26 | 15.7 | 0 | 0 |
| 13 | 0.77 | 1.57 | 15.9 | 0 | 0 |
| 14 | 0.62 | 1.89 | 16.1 | 1 | 0 |
| 15 | 0.92 | 1.57 | 17.3 | 0 | 0 |
| 16 | 0.77 | 1.89 | 17.5 | 0 | 0 |
| 17 | 1.23 | 1.26 | 18.6 | 0 | 0 |
| 18 | 0.92 | 1.89 | 18.9 | 0 | 0 |
| 19 | 1.23 | 1.57 | 20.2 | 0 | 0 |
| 20 | 1.54 | 1.26 | 21.5 | 0 | 0 |
| 21 | 1.23 | 1.89 | 21.8 | 0 | 0 |
| 22 | 1.54 | 1.57 | 23.1 | 0 | 0 |
| 23 | 1.54 | 1.89 | 24.7 | 0 | 0 |

[1]Includes magnesium sulfonate, LOB and HOB calcium sulfonate.

As is evident from Table I, after approximately 3 months of storage, no finished oil containing at least 15 mm/kg of detergent surfactant contained any sign of floc or skinning. Initial appearance correlates well with final appearance. The final appearance was determined after the finished oil had been stored for approximately 3 months.

Effect of Detergent Surfactant Concentration on Composition Compatibility—Oleyl Amide Compositions A similar effect on compatibility is seen with additive compositions containing polybutene succinimide dispersant, oleyl amide friction modifier, and magnesium sulfonate detergent, and varying amounts of the LOB Sulfonate and HOB sulfonate disclosed above. In addition to these components, the compositions contained approximately constant amounts of antiwear additives, corrosion inhibitors, friction modifiers not of the invention, antioxidants, and diluent oil. All compositions contained approximately 5 wt-% oleyl amide.

TABLE II

| Example | Wt-% Actives Polybutene Succinimide | Wt-% LOB Sulfonate | Wt-% HOB Sulfonate | Additive Composition soap content, mm sulfonate surfactant | Initial Appearance | Final Appearance |
|---|---|---|---|---|---|---|
| 24 | 18.71 | 12.07 | 15.38 | 83.0 | 3 | 2 |
| 25 | 18.15 | 14.63 | 14.91 | 97.9 | 3 | 3 |
| 26 | 19.34 | 9.35 | 15.89 | 110.6 | 3 | 3 |
| 27 | 19.98 | 6.44 | 16.42 | 111.8 | 3 | 3 |
| 28 | 20.70 | 3.34 | 17.01 | 124.1 | 1 | 2 |
| 29 | 21.44 | 0 | 17.62 | 124.8 | 1 | 2 |
| 30 | 18.73 | 15.1 | 12.31 | 136.1 | 1 | 1 |
| 31 | 20.70 | 6.67 | 13.61 | 136.6 | 3 | 2 |
| 32 | 19.34 | 12.47 | 12.71 | 136.9 | 2 | 2 |
| 33 | 17.60 | 14.18 | 17.35 | 148.2 | 1 | 0 |
| 34 | 18.13 | 11.69 | 17.88 | 148.3 | 1 | 1 |
| 35 | 19.32 | 6.23 | 19.05 | 159.6 | 1 | 0 |
| 36 | 21.47 | 3.46 | 14.11 | 159.8 | 0 | 0 |
| 37 | 22.26 | 0 | 14.64 | 160.1 | 0 | 0 |
| 38 | 19.98 | 3.22 | 19.71 | 170.5 | 0 | 0 |
| 39 | 20.68 | 0 | 20.39 | 171.0 | 0 | 0 |
| 40 | 19.66 | 7.92 | 16.15 | 181.2 | 0 | 0 |
| 41 | 20.34 | 8.2 | 13.38 | 182.3 | 0 | 0 |
| 42 | 19.01 | 7.66 | 18.75 | 192.2 | 0 | 0 |
| 43 | 20.01 | 9.67 | 13.15 | 201.4 | 0 | 0 |

TABLE II-continued

| Example | Wt-% Actives Polybutene Succinimide | Wt-% LOB Sulfonate | Wt-% HOB Sulfonate | Additive Composition soap content, mm sulfonate surfactant | Initial Appearance | Final Appearance |
|---|---|---|---|---|---|---|
| 44 | 18.71 | 9.05 | 18.45 | 203.3 | 0 | 0 |
| 45 | 19.96 | 0 | 22.97 | 212.2 | 0 | 0 |
| 46 | 19.30 | 0 | 25.38 | 220.5 | 0 | 0 |

As is readily apparent from Table II, after approximately 3 months of storage, no additive composition containing at least 150 mm/kg of detergent surfactant contained any sign of skinning or gel. The final appearance of the additive composition was determined after the additive composition had been stored for approximately 3 months.

It is understood that although modifications and variations of the invention can be made without departing from the spirit and scope thereof, only such limitations should be imposed as are indicated in the appended claims.

What is claimed is:

1. A lubricating oil composition comprising:

(a) a major amount of base oil of lubricating viscosity;

(b) at least 0.50 wt-% of at least one fatty acid amide friction modifier having a melting point of greater than 50° C.;

(c) at least 1 wt-% of a polybutylene succinimide dispersant; and (d) a sufficient amount of at least one neutral calcium sulfonate surfactant and at least one overbased calcium sulfonate surfactant to make said lubricating oil composition haze-, sediment-, and skin-free after about three months of storage, provided that said lubricating oil composition contains at least 14.5 mM of total surfactant per kg of said lubricating oil composition; and wherein the lubricating oil composition is a tractor hydraulic fluid.

2. The lubricating oil composition of claim 1 wherein the lubricating oil composition contains at least 20 mM of total surfactant per kg of lubricating oil composition.

3. The lubricating oil composition of claim 2 wherein the lubricating oil composition contains at least 25 mM of total surfactant per kg of lubricating oil composition.

4. The lubricating oil composition of claim 3 wherein the lubricating oil composition contains at least 30 mM of total surfactant per kg of lubricating oil composition.

5. The lubricating oil composition of claim 1 wherein the polybutylene substituent of the polybutylene succinimide dispersant is derived from polyisobutylene having at least 50 mole % of a methylvinylidene isomer.

6. The lubricating oil composition of claim 1 further comprising at least one additive selected from the group consisting of an anti oxidant, anti-wear agent, rust inhibitor, demulsifier, extreme pressure agent, multifunctional additive, viscosity index improver, pour point depressants, foam inhibitor, and metal deactivator.

* * * * *